US009324286B2

(12) United States Patent
Mori et al.

(10) Patent No.: US 9,324,286 B2
(45) Date of Patent: Apr. 26, 2016

(54) MULTIPLE PRIMARY COLOR LIQUID CRYSTAL DISPLAY DEVICE AND SIGNAL CONVERSION CIRCUIT

(75) Inventors: Tomohiko Mori, Osaka (JP); Kazunari Tomizawa, Osaka (JP); Yuichi Yoshida, Osaka (JP); Kozo Nakamura, Osaka (JP); Shun Ueki, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 1174 days.

(21) Appl. No.: 13/131,289

(22) PCT Filed: Nov. 24, 2009

(86) PCT No.: PCT/JP2009/006319

§ 371 (c)(1),
(2), (4) Date: May 26, 2011

(87) PCT Pub. No.: WO2010/061577

PCT Pub. Date: Jun. 3, 2010

(65) Prior Publication Data

US 2011/0227965 A1 Sep. 22, 2011

(30) Foreign Application Priority Data

Nov. 28, 2008 (JP) ..... 2008-305547

(51) Int. Cl.

| | |
|---|---|
| ***G09G 3/36*** | (2006.01) |
| *G09G 5/02* | (2006.01) |
| *G09G 5/06* | (2006.01) |

(52) U.S. Cl.

CPC ..... *G09G 3/3648* (2013.01); *G09G 3/3607* (2013.01); *G09G 5/026* (2013.01);

(Continued)

(58) Field of Classification Search

None

See application file for complete search history.

(56) References Cited

U.S. PATENT DOCUMENTS

| | | | |
|---|---|---|---|
| 4,800,375 | A | 1/1989 | Silverstein et al. |
| 6,661,488 | B1 | 12/2003 | Takeda et al. |

(Continued)

FOREIGN PATENT DOCUMENTS

| | | | |
|---|---|---|---|
| JP | 09-251160 | A | 9/1997 |
| JP | 11-242225 | A | 9/1999 |

(Continued)

OTHER PUBLICATIONS

English translation of Official Communication issued in corresponding International Application PCT/JP2009/006319, mailed on Jul. 14, 2011.

(Continued)

*Primary Examiner* — Srilakshmi K Kumar
*Assistant Examiner* — Parul Gupta
(74) *Attorney, Agent, or Firm* — Keating & Bennett, LLP

(57) ABSTRACT

The viewing angle characteristics of a multiprimary liquid crystal display device in which a plurality of red subpixels are provided in each pixel are improved.

A multiprimary liquid crystal display device according to the present invention includes a pixel defined by a plurality of subpixels, and performs multicolor display by using four or more primary colors to be displayed by the plurality of subpixels. The plurality of subpixels of the multiprimary liquid crystal display device according to the present invention include first and second red subpixels R1 and R2 for displaying red, a green subpixel G for displaying green, a blue subpixel B for displaying blue, and a cyan subpixel C for displaying cyan. When a color having a hue which is within a predetermined first range is displayed by the pixel, the gray scale level of the first red subpixel R1 and the gray scale level of the second red subpixel R2 differ from each other. When a color having a hue which is within a second range different from the first range is displayed by the pixel, the gray scale level of the first red subpixel R1 and the gray scale level of the second red subpixel R2 are equal.

21 Claims, 11 Drawing Sheets

(52) U.S. Cl.
CPC ..... *G09G 5/06* (2013.01); *G09G 2300/0426* (2013.01); *G09G 2300/0439* (2013.01); *G09G 2300/0443* (2013.01); *G09G 2300/0447* (2013.01); *G09G 2300/0452* (2013.01); *G09G 2320/028* (2013.01); *G09G 2320/0242* (2013.01); *G09G 2320/0666* (2013.01); *G09G 2340/06* (2013.01)

(56) References Cited

U.S. PATENT DOCUMENTS

| | | | | |
|---|---|---|---|---|
| 7,145,624 | B2 | 12/2006 | Kubo et al. | |
| 7,530,722 | B2 * | 5/2009 | Murai | 362/613 |
| 8,179,502 | B2 * | 5/2012 | Roth et al. | 349/106 |
| 2004/0174389 | A1 | 9/2004 | Ben-David et al. | |
| 2005/0122294 | A1 | 6/2005 | Ben-David et al. | |
| 2005/0225574 | A1 * | 10/2005 | Brown Elliott et al. | 345/694 |
| 2007/0063946 | A1 * | 3/2007 | Nakamura et al. | 345/88 |
| 2008/0036718 | A1 * | 2/2008 | Lee | 345/88 |
| 2009/0128478 | A1 * | 5/2009 | Dembo | 345/98 |
| 2009/0322662 | A1 * | 12/2009 | Yoshida et al. | 345/88 |
| 2010/0066956 | A1 | 3/2010 | Nakamura et al. | |

FOREIGN PATENT DOCUMENTS

| | | | |
|---|---|---|---|
| JP | 2001-209047 | A | 8/2001 |
| JP | 2001-306023 | A | 11/2001 |
| JP | 2003-043525 | A | 2/2003 |
| JP | 2004-529396 | A | 9/2004 |

OTHER PUBLICATIONS

Official Communication issued in International Patent Application No. PCT/JP2009/006319, mailed on Jan. 12, 2010.

Pointer; "The Gamut of Real Surface Colours"; Color Research and Application; vol. 5; No. 3; Fall 1980; pp. 145-155.

Yang et al.; "31.1: Development of Six Primary-Color LCD"; Society For Information Display, 2005 International Symposium Digest of Technical Papers; vol. XXXVI; Book II; May 25-27, 2005; pp. 1210-1213.

Chino et al.; "25.1: Invited Paper: Development of Wide-Color-Gamut Mobile Displays With Four-Primary-Color LCDS"; Society For Information Display, 2006 International Symposium Digest of Technical Papers; vol. XXXVII, Book II; Jun. 7-9, 2006; pp. 1221-1224.

Ben-Chorin; "Improving LCD TV Color Using Multi-Primary Technology"; FPD International 2005 Forum; Oct. 19, 2005; 66 pages.

* cited by examiner

MULTIPLE PRIMARY COLOR LIQUID CRYSTAL DISPLAY DEVICE AND SIGNAL CONVERSION CIRCUIT

TECHNICAL FIELD

The present invention relates to a liquid crystal display device, and more particularly to a multiprimary liquid crystal display device which performs display by using four or more primary colors. The present invention also relates to a signal conversion circuit for use in a multiprimary liquid crystal display device.

BACKGROUND ART

Currently, various display devices are used in a variety of applications. In commonly-used display devices, each pixel is composed of three subpixels for displaying three primaries of light, i.e., red, green and blue, whereby multicolor display is achieved.

However, conventional display devices have a problem in that they can only display colors in a narrow range (referred to as a "color gamut"). FIG. 17 shows a color gamut of a conventional display device which performs display by using three primaries. FIG. 17 is an xy chromaticity diagram in an XYZ color system, where a color gamut is shown by a triangle whose apices are at three points corresponding to the three primaries of red, green and blue. Also shown in the figure are plotted colors (represented by "×" symbols) of various objects existing in nature, as taught by Pointer (see Non-Patent Document 1). As can be seen from FIG. 17, there are some object colors which do not fall within the color gamut. Thus, display devices which perform display by using three primaries are unable to display some object colors.

Therefore, in order to broaden the color gamut of a display device, there has been proposed a technique which increases the number of primary colors to be used for displaying to four or more.

For example, as shown in FIG. 18, Patent Document 1 discloses a liquid crystal display device 800 each of whose pixels P is composed of six subpixels R, G, B, Y, C and M for displaying red, green, blue, yellow, cyan, and magenta. The color gamut of the liquid crystal display device 800 is shown in FIG. 19. As shown in FIG. 19, a color gamut which is represented as a hexagonal shape whose apices are at six points corresponding to the six primary colors essentially encompasses all object colors. Thus, the color gamut can be broadened by increasing the number of primary colors to be used for displaying. In the present specification, liquid crystal display devices which perform display by using three primary colors will be collectively referred to as "three-primary liquid crystal display devices", and liquid crystal display devices which perform display by using four or more primary colors will be collectively referred to as "multiprimary liquid crystal display devices".

However, sufficient display quality may not be achieved by merely increasing the number of primary colors. For example, in a liquid crystal display device 800 disclosed in Patent Document 1, the actually-displayed red colors will appear blackish red (i.e., dark red), which means that there actually exist some object colors that cannot be displayed. The reason why red appears blackish (darkened) in the liquid crystal display device 800 of Patent Document 1 is as follows.

When the number of primary colors to be used for displaying is increased, the number of subpixels per pixel increases, which inevitably reduces the area of each subpixel. This results in a lowered lightness (which corresponds to the Y value in the XYZ color system) of the color to be displayed by each subpixel. For example, if the number of primary colors used for displaying is increased from three to six, the area of each subpixel is reduced to about half, so that the lightness (Y value) of each subpixel is also reduced to about half.

"Lightness" is one of the three factors which define a color, besides "hue" and "chroma". Therefore, even if the color gamut on the xy chromaticity diagram (i.e., the reproducible range of "hue" and "chroma") may be broadened by increasing the number of primary colors as shown in FIG. 19, the lowered "lightness" prevents the actual color gamut (i.e., the color gamut which also takes "lightness" into account) from becoming sufficiently wide.

While subpixels for displaying green or blue can still sufficiently display various object colors under lowered lightness, the subpixels for displaying red will become unable to display some object colors under lowered lightness. Thus, if the lightness (Y value) becomes lower because of using an increased number of primary colors, the display quality of red is degraded such that red appears blackish red (i.e., dark red).

Techniques for solving this problem are proposed in Patent Documents 2 and 3. As is disclosed in Patent Documents 2 and 3, by providing two red subpixels in one pixel, the lightness (Y value) of red can be improved, thus making it possible to display bright red. In other words, it is possible to broaden the color gamut which takes lightness into account in addition to the hue and chroma represented on the xy chromaticity diagram. It is commonplace for the two red subpixels that are provided within the same pixel to be driven at the same gray scale level (same luminance) for circuit simplification.

CITATION LIST

Patent Literature

[Patent Document 1] Japanese National Phase PCT Laid-Open Publication No. 2004-529396

[Patent Document 2] International Publication No. 2007/034770

[Patent Document 3] International Publication No. 2008/114695

Non-Patent Literature

[Non-Patent Document 1] M. R. Pointer, "The gamut of real surface colors," Color Research and Application, Vol. 5, No. 3, pp. 145-155 (1980)

SUMMARY OF INVENTION

Technical Problem

The inventors have found that, in the case of providing two red subpixels in one pixel of a multiprimary liquid crystal display device as is disclosed in Patent Documents 2 and 3, viewing angle characteristics are greatly affected by the manner in which the two red subpixels that are provided within the same pixel are driven.

The present invention has been made in view of the above problems, and an objective thereof is to improve the viewing angle characteristics of a multiprimary liquid crystal display device in which a plurality of red subpixels are provided in each pixel.

Solution to Problem

A multiprimary liquid crystal display device according to the present invention is a multiprimary liquid crystal display device comprising a pixel defined by a plurality of subpixels, the multiprimary liquid crystal display device performing multicolor display by using four or more primary colors to be displayed by the plurality of subpixels, wherein, the plurality of subpixels include first and second red subpixels for displaying red, a green subpixel for displaying green, a blue subpixel for displaying blue, and a cyan subpixel for displaying cyan; and when a color having a hue within a predetermined first range is displayed by the pixel, a gray scale level of the first red subpixel and a gray scale level of the second red subpixel differ from each other, and when a color having a hue within a second range which is different from the first range is displayed by the pixel, the gray scale level of the first red subpixel and the gray scale level of the second red subpixel are equal.

In a preferred embodiment, the plurality of subpixels further include a yellow subpixel for displaying yellow.

Alternatively, a multiprimary liquid crystal display device according to the present invention is a multiprimary liquid crystal display device comprising a pixel defined by a plurality of subpixels, the multiprimary liquid crystal display device performing multicolor display by using four or more primary colors to be displayed by the plurality of subpixels, wherein, the plurality of subpixels include first and second red subpixels for displaying red, a green subpixel for displaying green, a blue subpixel for displaying blue, and a yellow subpixel for displaying yellow; and when a color having a hue within a predetermined first range is displayed by the pixel, a gray scale level of the first red subpixel and a gray scale level of the second red subpixel differ from each other, and when a color having a hue within a second range which is different from the first range is displayed by the pixel, the gray scale level of the first red subpixel and the gray scale level of the second red subpixel are equal.

In a preferred embodiment, a multiprimary liquid crystal display device according to the present invention comprises a multiprimary signal generation circuit for receiving an input video signal corresponding to three primaries and generating a multiprimary signal corresponding to four or more primary colors.

In a preferred embodiment, a multiprimary liquid crystal display device according to the present invention further comprises a red subpixel independent driving circuit for, depending on a hue of a color represented by the input video signal, determining the gray scale level of the first red subpixel and the gray scale level of the second red subpixel from a red component contained in the multiprimary signal.

In a preferred embodiment, the red subpixel independent driving circuit uses a predetermined weight function to determine the gray scale level of the first red subpixel and the gray scale level of the second red subpixel.

In a preferred embodiment, the weight function is designated as H; gray scale levels of a red component, a green component, and a blue component contained in the input video signal are Rin, Gin, and Bin, respectively; a normalized luminance represented by the red component contained in the multiprimary signal is Y(Rout); and normalized luminances of the first red subpixel and the second red subpixel are Y(R1out) and Y(R2out), respectively, and the weight function H is expressed as H=(Rin−Gin)/Rin in the case where Rin>Gin>Bin, H=(Rin−Bin)/Rin in the case where Rin>Bin>Gin, or H=0 in any other case, and the normalized luminance Y(R1out) of the first red subpixel and the normalized luminance Y(R2out) of the second red subpixel are expressed as Y(R1out)=H×Y(Rout) and Y(R2out)=(2−H)XY(Rout) in the case where (2−H)×Y(Rout)≤1, or Y(R1out)=2×Y(Rout))−1 and Y(R2out)=1 in the case where (2−H)×Y(Rout)>1.

In a preferred embodiment, a multiprimary liquid crystal display device according to the present invention performs display in a vertical alignment mode.

A signal conversion circuit according to the present invention is a signal conversion circuit for use in a multiprimary liquid crystal display device having a pixel defined by a plurality of subpixels including first and second red subpixels for displaying red, a green subpixel for displaying green, a blue subpixel for displaying blue, and a cyan subpixel for displaying cyan, the multiprimary liquid crystal display device performing multicolor display by using four or more primary colors to be displayed by the plurality of subpixels, the signal conversion circuit comprising: a multiprimary signal generation circuit for receiving an input video signal corresponding to three primaries and generating a multiprimary signal corresponding to four or more primary colors; and a red subpixel independent driving circuit for, depending on a hue of a color represented by the input video signal, determining the gray scale level of the first red subpixel and the gray scale level of the second red subpixel from a red component contained in the multiprimary signal.

Alternatively, a signal conversion circuit according to the present invention is a signal conversion circuit for use in a multiprimary liquid crystal display device having a pixel defined by a plurality of subpixels including first and second red subpixels for displaying red, a green subpixel for displaying green, a blue subpixel for displaying blue, and a yellow subpixel for displaying yellow, the multiprimary liquid crystal display device performing multicolor display by using four or more primary colors to be displayed by the plurality of subpixels, the signal conversion circuit comprising: a multiprimary signal generation circuit for receiving an input video signal corresponding to three primaries and generating a multiprimary signal corresponding to four or more primary colors; and a red subpixel independent driving circuit for, depending on a hue of a color represented by the input video signal, determining the gray scale level of the first red subpixel and the gray scale level of the second red subpixel from a red component contained in the multiprimary signal.

In a preferred embodiment, the red subpixel independent driving circuit uses a predetermined weight function to determine the gray scale level of the first red subpixel and the gray scale level of the second red subpixel.

In a preferred embodiment, the weight function is designated as H; gray scale levels of a red component, a green component, and a blue component contained in the input video signal are Rin, Gin, and Bin, respectively; a normalized luminance represented by the red component contained in the multiprimary signal is Y(Rout); and normalized luminances of the first red subpixel and the second red subpixel are Y(R1out) and Y(R2out), respectively, and the weight function H is expressed as H=(Rin−Gin)/Rin in the case where Rin>Gin>Bin, H=(Rin−Bin)/Rin in the case where Rin>Bin>Gin, or H=0 in any other case, and the normalized luminance Y(R1out) of the first red subpixel and the normalized luminance Y(R2out) of the second red subpixel are expressed as Y(R1out)=H×Y(Rout) and Y(R2out)=(2−H)×Y(Rout) in the case where (2−H)×Y(Rout)≤1, or Y(R1out)=2×Y(Rout)−1 and Y(R2out)=1 in the case where (2−H)×Y(Rout)>1.

A multiprimary liquid crystal display device according to the present invention comprises a signal conversion circuit having the above construction.

Advantageous Effects of Invention

According to the present invention, the viewing angle characteristics of a multiprimary liquid crystal display device in which a plurality of red subpixels are provided in each pixel can be improved.

DESCRIPTION OF EMBODIMENTS

Hereinafter, an embodiment of the present invention will be described with reference to the drawings. Note that the present invention is not limited to the following embodiment.

Figure 1:
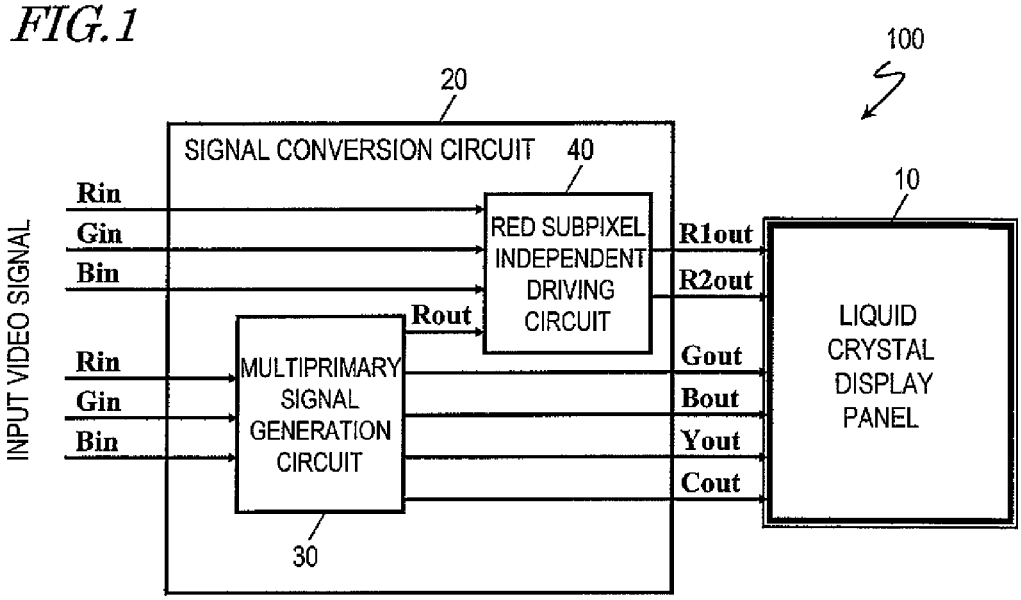
FIG. 1 A block diagram schematically showing a liquid crystal display device 100 according to a preferred embodiment of the present invention.

FIG. 1 shows a liquid crystal display device 100 according to the present embodiment. As shown in FIG. 1, the liquid crystal display device 100 is a multiprimary liquid crystal display device which performs multicolor display by using five primary colors, including a liquid crystal display panel 10 and a signal conversion circuit 20.

Figure 2:
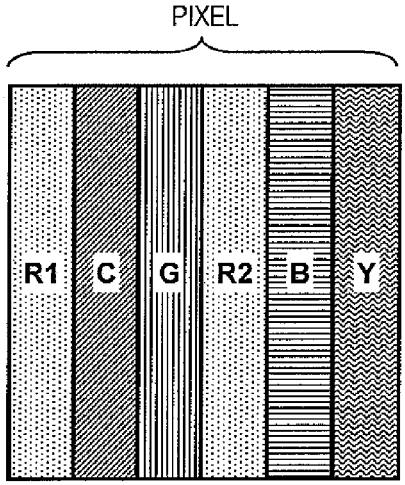
FIG. 2 A diagram showing an exemplary pixel construction of the liquid crystal display device 100.

The liquid crystal display device 100 includes a plurality of pixels which are arranged in a matrix array. Each pixel is defined by a plurality of subpixels. FIG. 2 shows an exemplary pixel construction of the liquid crystal display device 100. In the example shown in FIG. 2, the plurality of subpixels defining each pixel are first and second red subpixels R1 and R2 for displaying red, a green subpixel G for displaying green, a blue subpixel B for displaying blue, a yellow subpixel Y for displaying yellow, and a cyan subpixel C for displaying cyan.

In the example shown in FIG. 2, the first red subpixel R1, the cyan subpixel C, the green subpixel G, the second red subpixel R2, the blue subpixel B, and the yellow subpixel Y are arranged in this order from the left-hand side within the pixel. However, the arrangement of the plurality of subpixels is not limited thereto. Various arrangements which are disclosed in Patent Documents 2 and 3 can be adopted.

The signal conversion circuit 20 converts an input video signal corresponding to three primaries to signals for driving the first and second red subpixels R1 and R2, green subpixel G, blue subpixel B, yellow subpixel Y, and cyan subpixel C, i.e., signals representing the gray scale levels of these subpixels.

The liquid crystal display panel 10 receives the signals which are output from the signal conversion circuit 20, and the plurality of subpixels contained in each pixel are lit respectively at gray scale levels corresponding to the output signals of the signal conversion circuit 20. As a result, multicolor display using five primary colors is performed. The liquid crystal display panel 10 performs display in a vertical alignment mode (VA mode). As the vertical alignment mode, specifically, the MVA (Multi-domain Vertical Alignment) mode as is disclosed in Japanese Laid-Open Patent Publication No. 11-242225 or the CPA (Continuous Pinwheel Alignment) mode as is disclosed in Japanese Laid-Open Patent Publication No. 2003-43525 can be used. A panel of the MVA mode or the CPA mode has a vertical-alignment type liquid crystal layer in which liquid crystal molecules are aligned perpendicularly to the substrate in the absence of an applied voltage, and the liquid crystal molecules tilt in a plurality of azimuth directions within each subpixel under an applied voltage, thereby realizing display with a wide viewing angle.

In the liquid crystal display device 100 of the present embodiment, when a color having a hue which is within a predetermined range (hereinafter referred to as the "first range") is displayed by a pixel, the gray scale level of the first red subpixel R1 and the gray scale level of the second red subpixel R2 differ from each other. In other words, the first red subpixel R1 and the second red subpixel R2 are independently driven. On the other hand, when a color having a hue which is within a range (hereinafter referred to as the "second range") that is different from the first range is displayed by a pixel, the gray scale level of the first red subpixel R1 and the gray scale level of the second red subpixel R2 are equal. In other words, the first red subpixel R1 and the second red subpixel R2 are not independently driven.

In order to realize the aforementioned independent driving of the first red subpixel R1 and the second red subpixel R2, the signal conversion circuit 20 in the present embodiment includes a multiprimary signal generation circuit and a red subpixel independent driving circuit 40, as shown in FIG. 1.

The multiprimary signal generation circuit (which hereinafter may also be simply referred to as the "multiprimary circuit") 30 receives an input video signal corresponding to the three primaries, and generates a multiprimary signal corresponding to four or more primary colors (of which there are five herein). The input video signal contains components representing the respective gray scale levels of the three primaries, specifically: a red component Rin representing the gray scale level of red; a green component Gin representing the gray scale level of green; and a blue component Bin representing the gray scale level of blue. The multiprimary signal contains components representing the respective gray scale levels of the five primary colors, specifically: a red component Rout representing the gray scale level of red; a green component Gout representing the gray scale level of green; a blue component Bout representing the gray scale level of blue; a yellow component Yout representing the gray scale level of yellow; and a cyan component Cout representing the gray scale level of cyan.

In accordance with the hue of a color represented by the input video signal, the red subpixel independent driving circuit (which hereinafter may also be simply referred to as the "independent driving circuit") 40 determines the gray scale level of the first red subpixel R1 and the gray scale level of the second red subpixel R2, from the red component Rout contained in the multiprimary signal. As is shown in FIG. 1, the independent driving circuit 40 receives the input video signal (containing the red component Rin, the green component Gin, and the blue component Bin) and the red component Rout of the multiprimary signal, and generates and outputs a signal R1out representing the gray scale level of the first red subpixel R1 and a signal R2out representing the gray scale level of the second red subpixel R2.

As described above, in the liquid crystal display device 100, the manner in which the first red subpixel R1 and the second red subpixel R2 are driven (i.e., the lighting pattern) varies depending on the hue of the color to be displayed by the pixel. This suppresses a deviation of chromaticity (color shift) under oblique observation as will be described later, thereby improving the viewing angle characteristics. Hereinafter, the reason why the aforementioned color shift occurs, and the reason why a color shift is suppressed by the present invention will be described.

As has already been described, display with a wide viewing angle is realized in the MVA mode and the CPA mode. In recent years, however, in wide-viewing-angle vertical alignment (VA) modes such as the MVA mode and the CPA mode, a viewing angle characteristics problem has been pointed out in that there is a difference between the y characteristics under frontal observation and the y characteristics under oblique observation, i.e., a problem of viewing angle dependence of the γ characteristics. The γ characteristics are the gray-scale-level dependence of display luminance. A viewing angle dependence of the γ characteristics in a vertical alignment mode is visually recognized as a phenomenon where an oblique observation results in a display luminance which is increased over the original display luminance. This phenomenon is referred to as "whitening".

Figure 3:
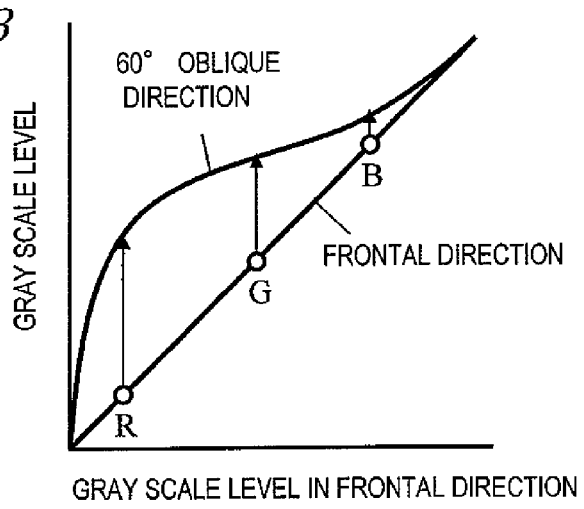
FIG. 3 A graph showing a relationship between gray-scale characteristics in the frontal direction and gray-scale characteristics in a 60° oblique direction of a subpixel in a three-primary liquid crystal display device which performs display in the MVA mode.

FIG. 3 shows a relationship between gray-scale characteristics in the frontal direction and gray-scale characteristics in a 60° oblique direction of a subpixel in a three-primary liquid crystal display device which performs display in the MVA mode. FIG. 3 is provided for clearly illustrating the difference between the gray-scale characteristics in the frontal direction and the gray-scale characteristics in the 60° oblique direction, where values on the horizontal axis represent gray scale levels in the frontal direction, and values on the vertical axis represent gray scale levels in the frontal direction and gray scale levels in the 60° oblique direction respectively for the frontal direction and the 60° oblique direction, thus clarifying the deviation of gray-scale characteristics.

In FIG. 3, the gray-scale characteristics in the frontal direction appear as a straight line, because the value on the horizontal axis=the value on the vertical axis. On the other hand, the gray-scale characteristics in the 60° oblique direction appear as a curve. The amount of deviation of this curve from the straight line representing the gray-scale characteristics in the frontal direction indicates a difference in gray scale level between the frontal observation and the oblique observation, this difference corresponding to the amount of deviation in luminance.

FIG. 3 shows a combination of gray scale levels of the red subpixel, the green subpixel, and the blue subpixel when the pixel displays a certain color. As will be seen from FIG. 3, the gray scale levels of the red subpixel, the green subpixel, and the blue subpixel become higher under oblique observation than under frontal observation. In other words, the luminances of the red subpixel, the green subpixel, and the blue subpixel have excesses (increases) under oblique observation, as compared to under frontal observation. Moreover, it is often the case that the gray scale levels of the red subpixel, the green subpixel, and the blue subpixel are different from one another when a certain color is displayed by the pixel, so that they will have different ratios of increase under oblique observation, as can be seen from FIG. 3. Therefore, the luminances of the red subpixel, the green subpixel, and the blue subpixel will increase with different ratios under oblique observation, which causes a deviation in the color that is displayed by the pixel.

In a multiprimary liquid crystal display device, too, color shifts occur under similar principles. However, in a multiprimary liquid crystal display device, this color shift can be suppressed by the following technique.

In a three-primary liquid crystal display device, there is only one combination of subpixel gray scale levels for a pixel to display a certain color. On the other hand, in a multiprimary liquid crystal display device, there are many combinations of subpixel gray scale levels for a pixel to display a certain color. This is because of the need for the multiprimary liquid crystal display device to convert an input video signal corresponding to three primaries (i.e., a three-dimensional signal) into a signal corresponding to four or more primary colors (i.e., a higher-order signal), which conversion permits high arbitrariness (freedom). Therefore, from among the large number of combinations of gray scale levels, a combination that allows the luminance of each subpixel under oblique observation to increase at the same ratio as much as possible may be selected in order to suppress color shifts.

However, depending on the color to be displayed, color shifts may not be adequately suppressed in a multiprimary liquid crystal display device, either. For example, in the pixel construction shown in FIG. 2 (which lacks a magenta subpixel), any color that is close to magenta is displayed by basically combining red and blue (i.e., the number of primary colors used for color mixing is small), and thus there are few combinations of gray scale levels that can be selected. This makes it difficult to adequately suppress color shifts. In the liquid crystal display device 100 of the present embodiment, color shifts in such cases are suppressed by ensuring that the gray scale level of the first red subpixel R1 and the gray scale level of the second red subpixel R2 differ from each other, that is, by independently driving the first red subpixel R1 and the second red subpixel R2.

Figure 4:
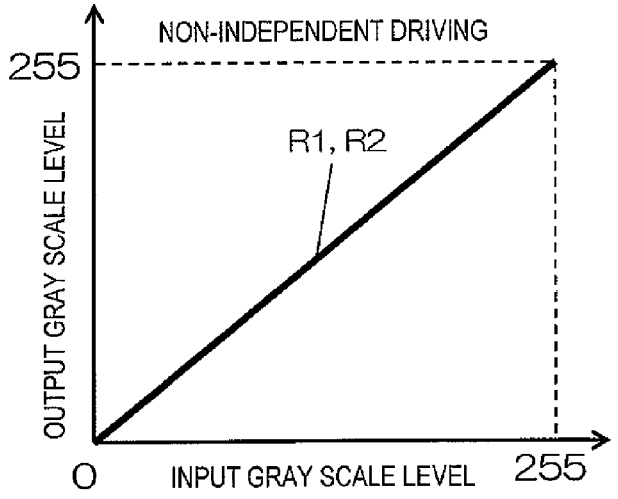
FIG. 4 A graph showing a relationship between the gray scale level (input gray scale level) of a red component of a multiprimary signal which is input to a red subpixel independent driving circuit 40 and the gray scale levels (output gray scale levels) of signals which are output from the red subpixel independent driving circuit 40, in the case where a first red subpixel R1 and a second red subpixel R2 are not independently driven (H=1).
Figure 5:
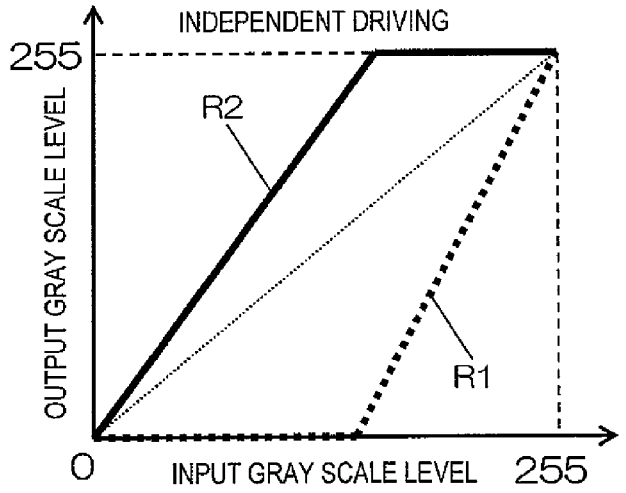
FIG. 5 A graph showing a relationship between the gray scale level (input gray scale level) of a red component of a multiprimary signal which is input to a red subpixel independent driving circuit 40 and the gray scale levels (output gray scale levels) of signals which are output from the red subpixel independent driving circuit 40, in the case where the first red subpixel R1 and the second red subpixel R2 are independently driven (H=0).

FIG. 4 and FIG. 5 show relationships between the gray scale level (input gray scale level) of the red component Rout which is input to the independent driving circuit 40 and the gray scale levels (output gray scale levels) of the signals R1out and R2out which are output from the independent driving circuit 40.

In the case where independent driving is not performed, as shown in FIG. 4, the gray scale level of the red component Rout straightforwardly becomes the gray scale levels of the signals R1out and R2out, i.e., the gray scale levels of the first red subpixel R1 and the second red subpixel R2. Therefore, the gray scale levels of the first red subpixel R1 and the second red subpixel R2 are equal.

On the other hand, in the case where independent driving is performed, as shown in FIG. 5, the gray scale level of the red component Rout does not straightforwardly become the gray scale levels of the signals R1out and R2out, so that the gray scale level of the first red subpixel R1 and the gray scale level of the second red subpixel R2 differ from each other. In the example shown in FIG. 5, as the input gray scale level increases from zero, only the gray scale level of the second red subpixel R2 increases first, while the gray scale level of the first red subpixel R1 remains zero. When the input gray scale level reaches a certain intermediate level, the gray scale level of the second red subpixel R2 reaches the highest level (which herein is 255). Thereafter, while the gray scale level of the second red subpixel R2 remains at the highest level, only the gray scale level of the first red subpixel R1 increases.

Figure 6:
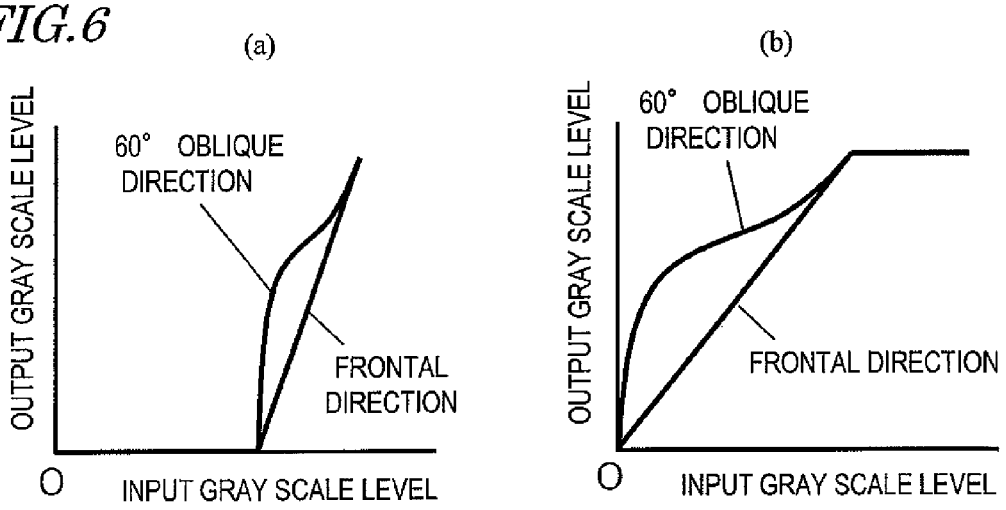
FIG. 6 (*a*) is a graph showing gray-scale characteristics under frontal observation and gray-scale characteristics under oblique observation, of the first red subpixel R1 in the case where independent driving is performed; and (*b*) is a graph showing gray-scale characteristics under frontal observation and gray-scale characteristics under oblique observation, of the second red subpixel R2 in the case where independent driving is performed.

FIG. 6(*a*) shows gray-scale characteristics under frontal observation and gray-scale characteristics under oblique observation, of the first red subpixel R1 in the case where independent driving is performed. FIG. 6(*b*) shows gray-scale characteristics under frontal observation and gray-scale characteristics under oblique observation, of the second red subpixel R2 in the case where independent driving is performed. As can be seen from a comparison between FIG. 6(*a*) and FIG. 6(*b*), between the first red subpixel R1 and the second red subpixel R2, the gray-scale characteristics under frontal observation are different, and therefore the gray-scale characteristics under oblique observation are also different.

Figure 7:
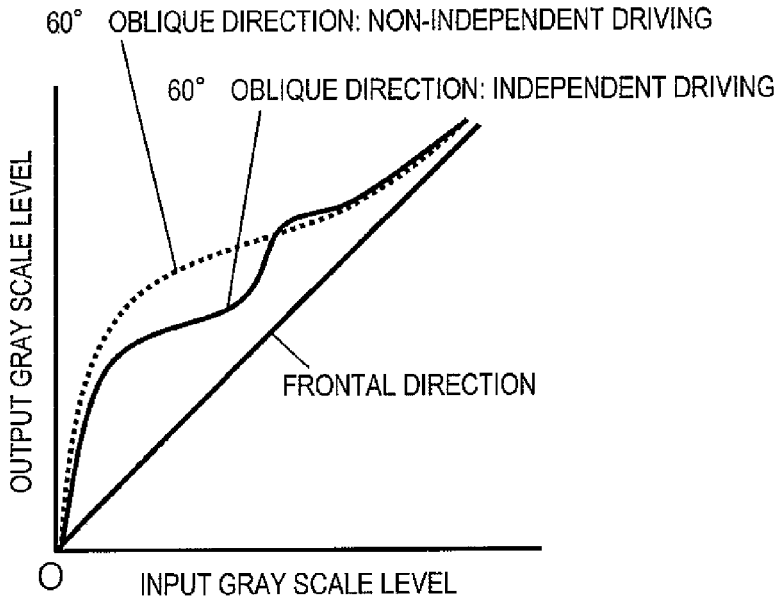
FIG. 7 A graph showing total gray-scale characteristics of the first red subpixel R1 and the second red subpixel R2 under oblique observation.

Therefore, the total gray-scale characteristics under oblique observation of the two subpixels for displaying red, i.e., the first red subpixel R1 and the second red subpixel R2 are an average of the respective gray-scale characteristics under oblique observation of the first red subpixel R1 and the second red subpixel R2, as shown in FIG. 7. As can also be seen from FIG. 7, the gray-scale characteristics under oblique observation in the case of performing independent driving have a smaller amount of deviation, from the gray-scale characteristics under frontal observation, than do the gray-scale characteristics under oblique observation in the case of not performing independent driving. Therefore, by independently driving the first red subpixel R1 and the second red subpixel R2, color shifts can be suppressed.

However, it has been found through a study of the inventors that, for colors of certain hues, color shifts can be better suppressed by not performing the above-described independent driving. For example, it is preferable to perform independent driving when displaying a bluish magenta (Bin>Rin>Gin=0), but it is preferable not to perform independent driving when displaying a reddish magenta (Rin>Bin>Gin=0).

Figure 8:
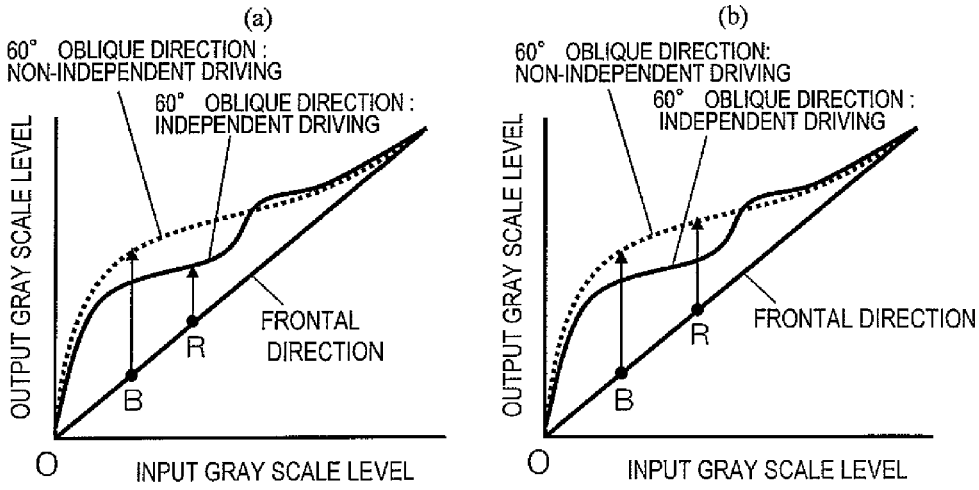
FIGS. 8 (*a*) and (*b*) are graphs showing excesses of red and blue when a reddish magenta is displayed, where: (a) corresponds to the case where independent driving is performed; and (b) corresponds to the case where independent driving is not performed.

FIGS. 8(*a*) and (*b*) show excesses of red and blue when a reddish magenta is displayed. FIG. 8(*a*) corresponds to the case of perform independent driving, and FIG. 8(*b*) corresponds to the case of not performing independent driving.

A comparison between FIG. 8(*a*) and FIG. 8(*b*) indicates that the excess of red is smaller in the case of performing independent driving as shown in FIG. 8(*a*) than in the case of not performing independent driving as shown in FIG. 8(*b*). However, in the case where independent driving is performed, because of the reduced excess of red, the gray scale level of red under oblique observation becomes lower than the gray scale level of blue, thus resulting in a reversal in relative magnitude of the gray scale level of red and the gray scale level of blue between the frontal observation and the oblique observation. Therefore, although the excess of red is smaller, the deviation in chromaticity is actually larger. On the other hand, when independent driving is not performed, although the excess of red itself is large, the gray scale level of red under oblique observation is higher than the gray scale level of blue, so that the relative magnitude of the gray scale level of red and the gray scale level of blue is conserved between the frontal observation and the oblique observation. As a result, color shifts are better suppressed than in the case of performing independent driving.

As described above, depending on the hue of the color which is displayed by the pixel, the first red subpixel R1 and the second red subpixel R2 are independently driven or non-independently driven in the liquid crystal display device 100 of the present embodiment, whereby the color shift under oblique observation is suppressed. Hereinafter, a specific example of driving control which is made in accordance with the hue will be described.

For example, the red subpixel independent driving circuit 40 of the liquid crystal display device 100 employs a predetermined weight function H to determine the gray scale level of the first red subpixel R1 and the gray scale level of the second red subpixel R2. This weight function H is expressed by the following eq. (1) in the case where Rin>Gin>Bin, the following eq. (2) in the case where Rin>Bin>Gin, or the following eq. (3) in any other case.

$$H=(R\text{in}-G\text{in})/R\text{in} \quad (1)$$

$$H=(R\text{in}-B\text{in})/R\text{in} \quad (2)$$

$$H=0 \quad (3)$$

In the above equations, Rin, Gin, and Bin respectively represent the gray scale levels represented by the red component Rin, the green component Gin, and the blue component Bin which are contained in the input video signal. Herein, a normalized luminance represented by the red component Rout contained in the multiprimary signal is denoted as Y(Rout), whereas normalized luminances represented by the signals R1out and R2out which are output from the independent driving circuit 40 (i.e., normalized luminances of the first red subpixel R1 and the second red subpixel R2) are denoted as Y(R1out) and Y(R2out), respectively. Herein, the normalized luminance Y (R1out) of the first red subpixel R1 and the normalized luminance Y (R2out) of the second red subpixel R2 are expressed by the following eqs. (4) and (5) in the case where (2−H)×Y(Rout)≤1.

$$Y(R1\text{out})=H\times Y(R\text{out}) \quad (4)$$

$$Y(R2\text{out})=(2-H)\times Y(R\text{out}) \quad (5)$$

Moreover, the normalized luminance Y(R1out) of the first red subpixel R1 and the normalized luminance Y (R2out) of the second red subpixel R2 are expressed by the following eqs. (6) and (7) in the case where (2−H)×Y(Rout)>1.

$$Y(R1\text{out})=2\times Y(R\text{out})-1 \quad (6)$$

$$Y(R2\text{out})=1 \quad (7)$$

Figure 9:
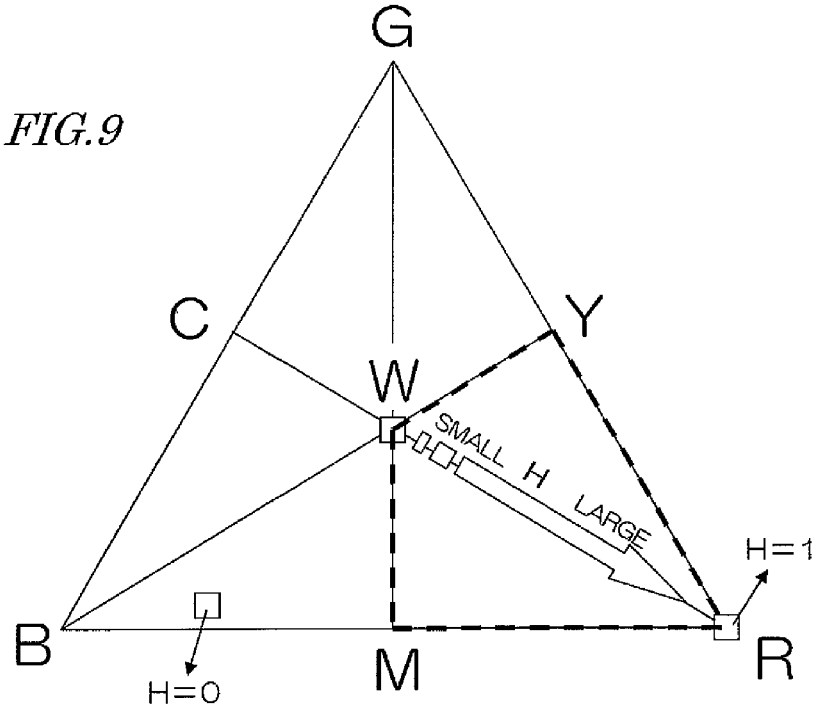
FIG. 9 A diagram for conceptual explanation of a specific example of a weight function.

FIG. 9 is a diagram for conceptual explanation of the weight function H as expressed by eqs. (1) to (3) above. The triangle in FIG. 9 schematically expresses a range of hue of colors which are represented by an input video signal (colors to be displayed by the pixel). In FIG. 9, W, R, G, B, Y, M, and C represent white, red, green, blue, yellow, magenta, and cyan, respectively.

The weight function H as expressed by eqs. (1) to (3) is a mathematical function that produces a greater value as the hue goes from white to red within a region surrounded by the broken line in FIG. 9 (a rectangle whose apices are W, M, R, and Y). For example, as shown in FIG. 9, when the color represented by the input video signal is the brightest red (Rin=1, Gin=0, Bin=0), then H=1. Moreover, the weight function H is a mathematical function such that H=0 in any region other than the region surrounded by the broken line in FIG. 9.

When H=1, as is also seen from eqs. (4) and (5), the normalized luminance of the red component Rout of the multiprimary signal straightforwardly becomes the normalized luminances of the first red subpixel R1 and the second red subpixel R2. That is, the gray scale level of the red component Rout of the multiprimary signal straightforwardly becomes the gray scale levels of the first red subpixel R1 and the second red subpixel R2. Therefore, as shown in FIG. 4, the gray scale level of the first red subpixel R1 and the gray scale level of the second red subpixel R2 are equal, so that independent driving is not performed.

When H=0, as is also seen from eqs. (4) and (5), in the range where the normalized luminance of the red component Rout of the multiprimary signal is equal to or less than 0.5 (Y(Rout)≤0,5), the normalized luminance of the first red subpixel R1 is zero, and the normalized luminance of the second red subpixel R2 is twice the normalized luminance of the red component Rout of the multiprimary signal. In the range where the normalized luminance of the red component Rout of the multiprimary signal exceeds 0.5 (Y(Rout)>0.5), as is also seen from eqs. (6) and (7), the normalized luminance of the first red subpixel R1 is a value obtained by subtracting 1 from twice the normalized luminance of the red component Rout of the multiprimary signal, and the normalized luminance of the second red subpixel R2 is 1. Thus, as shown in FIG. 5, the gray scale level of the first red subpixel R1 and the gray scale level of the second red subpixel R2 differ from each other, whereby independent driving is performed.

Figure 10:
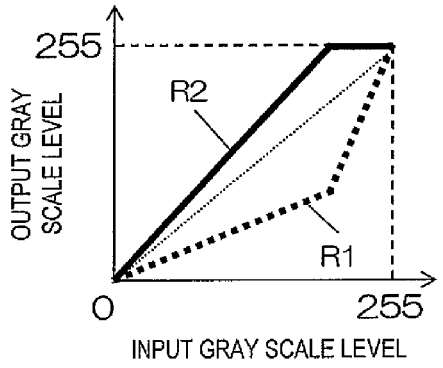
FIG. 10 A graph showing a relationship between the gray scale level (input gray scale level) of a red component of a multiprimary signal which is input to a red subpixel independent driving circuit 40 and the gray scale levels (output gray scale levels) of signals which are output from the red subpixel independent driving circuit 40, in the case where the first red subpixel R1 and the second red subpixel R2 are independently driven (H=0.5).

Independent driving is performed also when O<H<1. For example, when H=0.5, the gray scale levels of the first red subpixel R1 and the second red subpixel R2 have a relationship as shown in FIG. 10. In the example shown in FIG. 10, unlike in the example shown in FIG. 5, not only the gray scale level of the second red subpixel R2 but also the gray scale level of the first red subpixel R1 increases as the input gray scale level increases from zero. However, the ratio of increase in the gray scale level of the first red subpixel R1 is lower than the ratio of increase in the gray scale level of the second red subpixel R2. Once the input gray scale level reaches a certain intermediate level and the gray scale level of the second red subpixel R2 reaches the highest level, only the gray scale level of the first red subpixel R1 increases thereafter, while the gray scale level of the second red subpixel R2 remains at the highest level.

Next, a result of performing viewing angle characteristics simulations to verify the effects of the present invention will be described.

A simulation of viewing angle characteristics was first conducted with respect to the case where a bluish magenta is displayed by the pixel. The gray scale levels of the red component Rin, the green component Gin, and the blue component Bin contained in the input video signal are as shown in Table 1, and the chromaticities x and y and the Y value under frontal observation of a color which is displayed by the pixel are as shown in Table 2.

TABLE 1

| Rin | Gin | Bin |
|---|---|---|
| 150 | 0 | 200 |

TABLE 2

| x | y | Y |
|---|---|---|
| 0.259 | 0.120 | 0.086 |

Herein, the gray scale levels of the subpixels when the first red subpixel R1 and the second red subpixel R2 are not independently driven are as shown in Table 3, and the chromaticities x and y and the Y value under oblique observation (when observed from a 60° oblique direction) are as shown in Table 4. A color difference Δu'v' which is calculated from the chromaticity values x and y shown in Table 2 and the chromaticity values x and y shown in Table 4 is 0.098, as is also shown in Table 4.

TABLE 3

| R1 | R2 | G | B | Y | C |
|---|---|---|---|---|---|
| 148 | 148 | 0 | 200 | 0 | 79 |

TABLE 4

| x | y | Y | Δu'v' |
|---|---|---|---|
| 0.329 | 0.191 | 0.157 | 0.098 |

On the other hand, the gray scale levels of the subpixels when the first red subpixel R1 and the second red subpixel R2 are independently driven are as shown in Table 5, and the chromaticities x and y and the Y value under oblique observation (when observed from a 60° oblique direction) are as shown in Table 6. A color difference Δu'v' which is calculated from the chromaticity values x and y shown in Table 2 and the chromaticity values x and y shown in Table 6 is 0.079, as is also shown in Table 6.

TABLE 5

| R1 | R2 | G | B | Y | C |
|---|---|---|---|---|---|
| 0 | 202 | 0 | 200 | 0 | 79 |

TABLE 6

| x | y | Y | Δu'v' |
|---|---|---|---|
| 0.294 | 0.179 | 0.135 | 0.079 |

Thus, it has been confirmed that, by independently driving the first red subpixel R1 and the second red subpixel R2, the color difference Δu'v' between frontal observation and oblique observation is reduced, such that color shifts are suppressed.

Next, a simulation of viewing angle characteristics was conducted with respect to the case where a reddish magenta is displayed by the pixel. The gray scale levels of the red component Rin, the green component Gin, and the blue component Bin contained in the input video signal are as shown in Table 7, and the chromaticities x and y and the Y value under frontal observation of a color which is displayed by the pixel are as shown in Table 8.

TABLE 7

| Rin | Gin | Bin |
|---|---|---|
| 150 | 0 | 10 |

TABLE 8

| x | y | Y |
|---|---|---|
| 0.428 | 0.213 | 0.060 |

Herein, the gray scale levels of the subpixels when the first red subpixel R1 and the second red subpixel R2 are not independently driven are as shown in Table 9, and the chromaticities x and y and the Y value under oblique observation (when observed from a 60° oblique direction) are as shown in Table 10. A color difference Δu'v' which is calculated from the chromaticity values x and y shown in Table 8 and the chromaticity values x and y shown in Table 10 is 0.053, as is also shown in Table 10.

TABLE 9

| R1 | R2 | G | B | Y | C |
|---|---|---|---|---|---|
| 146 | 146 | 0 | 89 | 0 | 71 |

TABLE 10

| x | y | Y | Δu'v' |
|---|---|---|---|
| 0.391 | 0.234 | 0.143 | 0.053 |

On the other hand, the gray scale levels of the subpixels when the first red subpixel R1 and the second red subpixel R2 are independently driven are as shown in Table 11, and the chromaticities x and y and the Y value under oblique observation (when observed from a 60° oblique direction) are as shown in Table 12. A color difference Δu'v' which is calculated from the chromaticity values x and y shown in Table 8 and the chromaticity values x and y shown in Table 12 is 0.080, as is also shown in Table 12.

TABLE 11

| R1 | R2 | G | B | Y | C |
|---|---|---|---|---|---|
| 0 | 200 | 0 | 89 | 0 | 71 |

TABLE 12

| x | y | Y | Δu'v' |
|---|---|---|---|
| 0.352 | 0.224 | 0.120 | 0.080 |

Thus, it has been confirmed that, as far as colors of certain hues are concerned, the color difference Δu'v' between frontal observation and oblique observation is made smaller by not independently driving the first red subpixel R1 and the second red subpixel R2 than by independently driving them, thereby suppressing color shifts.

Although the above description illustrates an exemplary construction where one pixel is defined by six subpixels and multicolor display is performed by using five primary colors, the present invention is not limited thereto. It is also possible to adopt a construction where one pixel is defined by more (7 or more) subpixels and multicolor display is performed by using 6 or more primary colors, or a construction where one pixel is defined by five subpixels and multicolor display is performed by using four primary colors.

In the case where multicolor display is performed by using four primary colors, one pixel may be defined by a first red subpixel R1, a second red subpixel R2, a green subpixel G, a blue subpixel B, and a cyan subpixel C, or by a first red subpixel R1, a second red subpixel R2, a green subpixel G, a blue subpixel B, and a yellow subpixel Y. However, the effect of improving viewing angle characteristics according to the present invention is more enhanced in the former construction (where the pixel does not include a yellow subpixel Y but includes a cyan subpixel C) than in the latter construction (where the pixel does not include a cyan subpixel C but includes a yellow subpixel Y) for the following reason. When the pixel does not include a yellow subpixel Y, a color which is close to yellow can basically be displayed by combining red and green (i.e., the number of primary colors used for color mixing is small), and thus there are few combinations of gray scale levels that can be selected. Just as an effect of suppressing color shifts is obtained for colors which are close to magenta, an effect of suppressing color shifts can also be obtained for colors which are close to yellow by independently driving or non-independently driving the first red subpixel R1 and the second red subpixel R2 depending on the hue.

Figure 11:
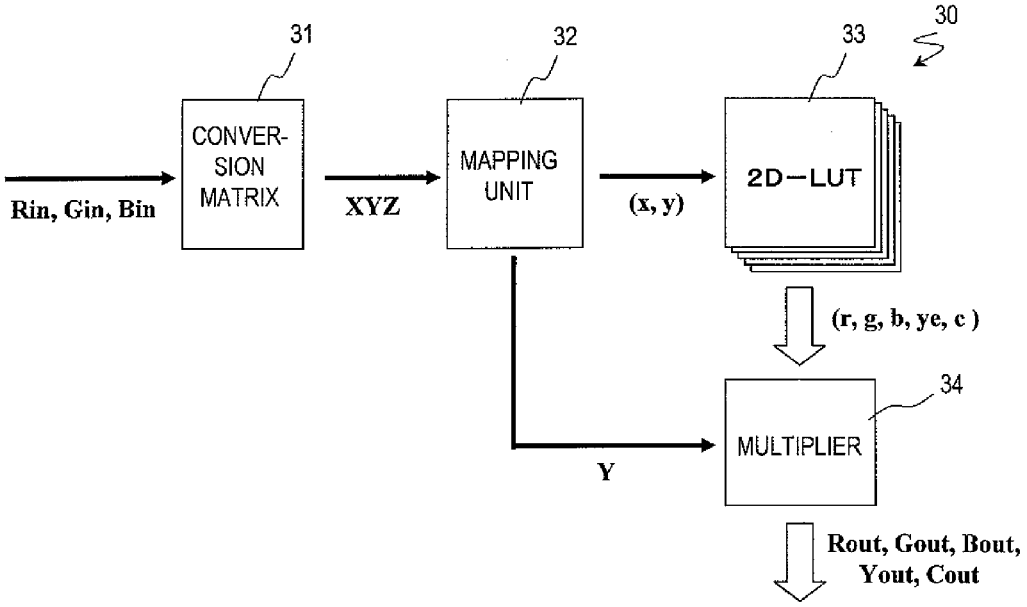
FIG. 11 A block diagram showing an example of a preferable construction of a multiprimary signal generation circuit 30.

FIG. 11 shows an example of a specific construction of the multiprimary signal generation circuit 30 which is included in the signal conversion circuit 20 of the liquid crystal display device 100. The multiprimary signal generation circuit 30 shown in FIG. 11 includes a conversion matrix 31, a mapping unit 32, a plurality of two-dimensional look-up tables 33 and a multiplier 34.

An externally-input video signal (Rin, Gin, Bin) is converted by the conversion matrix 31 into signals (XYZ signals) which correspond to the color space of the XYZ color system. The XYZ signals are mapped by the mapping unit 32 onto the xy coordinate space, whereby signals corresponding to the Y value and the chromaticity coordinates (x, y) are generated. There are as many two-dimensional look-up tables as there are primary colors, and based on the two-dimensional look-up tables 33, data (r, g, b, ye, c) corresponding to the hue and chroma of the primary colors to be used for color mixing is generated from the chromaticity coordinates (x, y). Such data and the Y value are multiplied by the multiplier 34, whereby signals Rout, Gout, Bout, Yout, and Cout corresponding to the respective primary colors are generated. Note that the technique described here is only an example, and the technique for generating a multiprimary signal is not limited thereto.

Note that the constituent elements in the signal conversion circuit 20 can be implemented in hardware, or some or all of them may be implemented in software. In the case where these constituent elements are implemented in software, they may be constructed by using a computer, this computer having a CPU (Central Processing Unit) for executing various programs, a RAM (Random Access Memory) functioning as a work area for executing such programs, and the like. Then, programs for realizing the functions of the respective constituent elements are executed in the computer, thus allowing the computer to operate as the respective constituent elements.

Next, a specific example of the construction of the liquid crystal display panel 10 will be described.

First, the fundamental construction of the MVA-mode liquid crystal display panel 10 will be described with reference to FIGS. 12(*a*) to (*c*).

Each subpixel of liquid crystal display panels 10A, 10B, and 10C includes a first electrode 1, a second electrode 2 opposing the first electrode 1, and a vertical-alignment type liquid crystal layer 3 provided between the first electrode 1 and the second electrode 2. In the vertical-alignment type liquid crystal layer 3, under no applied voltage, liquid crystal molecules 3*a* having a negative dielectric anisotropy are aligned substantially perpendicular (e.g., no less than 87° and no more than 90°) to the planes of the first electrode 1 and the second electrode 2. Typically, it is obtained by providing a vertical alignment film (not shown) on a surface, on the liquid crystal layer 3 side, of each of the first electrode 1 and the second electrode 2.

On the first electrode 1 side of the liquid crystal layer 3, first alignment regulating means (4, 5, 6) are provided. On the second electrode 2 side of the liquid crystal layer 3, second alignment regulating means (7, 8, 9) are provided. In a liquid crystal region which is defined between a first alignment regulating means and a second alignment regulating means, liquid crystal molecules 3*a* are subject to alignment regulating forces from the first alignment regulating means and the second alignment regulating means, and when a voltage is applied between the first electrode 1 and the second electrode 2, they fall (tilt) in a direction shown by arrows in the figure. That is, since the liquid crystal molecules 3*a* will fall in a uniform direction within each liquid crystal region, each liquid crystal region can be regarded as a domain.

Within each subpixel, the first alignment regulating means and second alignment regulating means (which may be collectively referred to as "alignment regulating means") are each provided in a stripe shape; FIGS. 12(*a*) to (*c*) are cross-sectional views along a direction which is orthogonal to the direction that the stripe-shaped alignment regulating means extend. On both sides of each alignment regulating means, liquid crystal regions (domains) are formed in which the liquid crystal molecules 3*a* fall in directions which are 180° apart. As the alignment regulating means, various alignment regulating means (domain restriction means) as disclosed in Japanese Laid-Open Patent Publication No. 11-242225 can be used.

Figure 12:
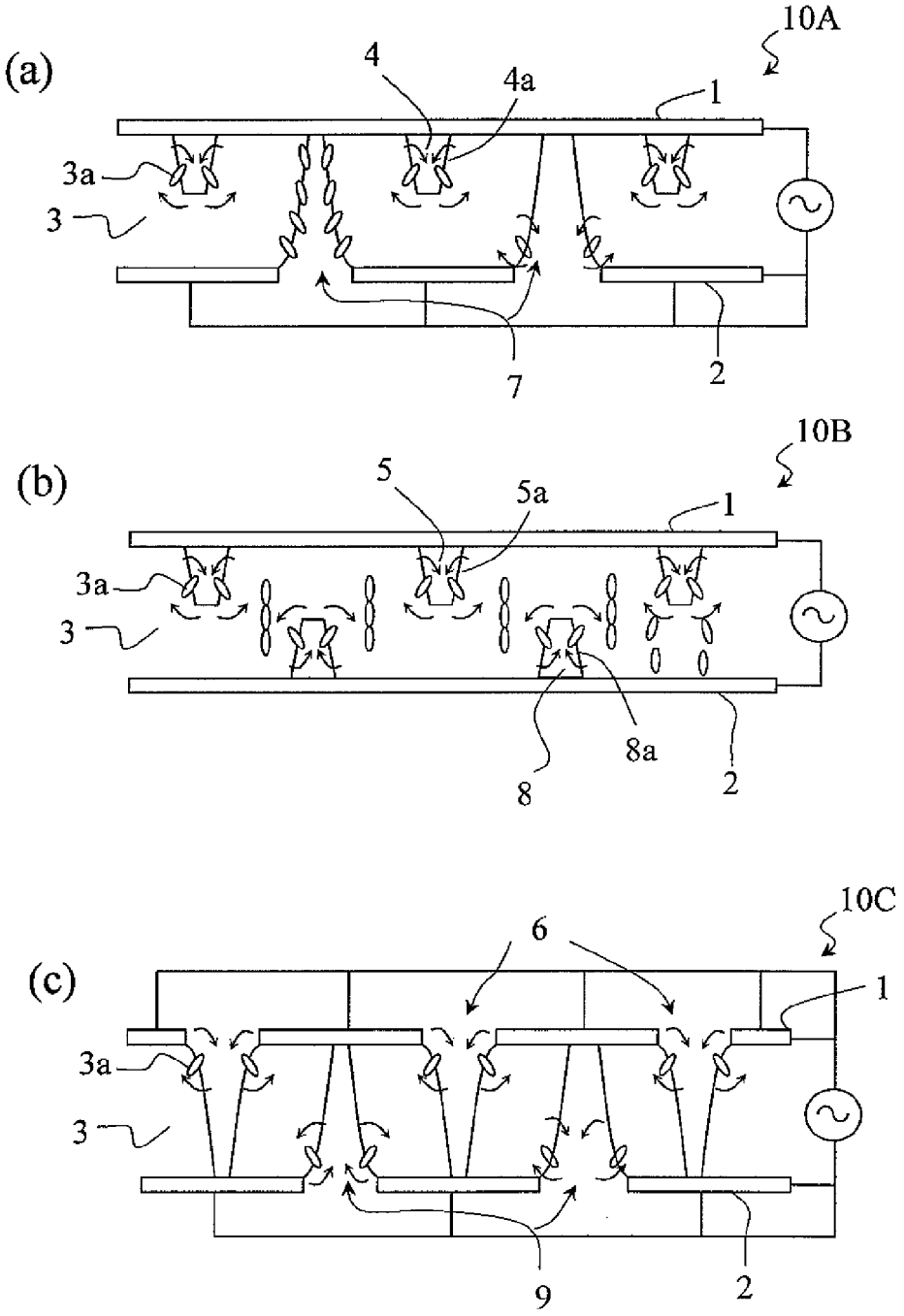
FIG. 12 (*a*) to (*c*) are diagrams for describing the fundamental constructions of MVA-mode liquid crystal display panels.

The liquid crystal display panel 10A shown in FIG. 12(*a*) includes ribs (protrusions) 4 as the first alignment regulating means, and slits (portions where the electrically-conductive film is absent) 7 provided in the second electrode 2 as the second alignment regulating means. The ribs 4 and the slits 7 are each provided in a stripe shape (strip shape). The ribs 4 cause the liquid crystal molecules 3*a* to be oriented substantially perpendicular to the side faces 4*a* thereof, so that the liquid crystal molecules 3*a* are oriented in a direction which is orthogonal to the extending direction of the ribs 4. When a potential difference is created between the first electrode 1 and the second electrode 2, each slit 7 generates an oblique field in the liquid crystal layer 3 near the edges of the slit 7, thus causing the liquid crystal molecules 3*a* to be oriented in a direction which is orthogonal to the extending direction of the slits 7. The ribs 4 and the slits 7 are disposed parallel to one another, with a constant interval therebetween, so that a liquid crystal region (domain) is formed between every adjoining rib 4 and slit 7.

The liquid crystal display panel 10B shown in FIG. 12(*b*) differs from the liquid crystal display panel 10A of FIG. 12(*a*) in that ribs (first ribs) 5 and ribs (second ribs) 8 are provided as the first alignment regulating means and the second alignment regulating means, respectively. The ribs 5 and the ribs 8 are disposed parallel to one another, with a constant interval therebetween, so that, by causing the liquid crystal molecules 3*a* to be oriented substantially perpendicular to side faces 5*a* of the ribs 5 and side faces 8*a* of the ribs 8, liquid crystal regions (domains) are formed therebetween.

The liquid crystal display panel 10C shown in FIG. 12(*c*) differs from the liquid crystal display panel 10A of FIG. 12(*a*) in that slits (first slits) 6 and slits (second slits) 9 are provided as the first alignment regulating means and the second alignment regulating means, respectively. When a potential difference is created between the first electrode 1 and the second electrode 2, a slit 6 and a slit 9 generate an oblique field in the liquid crystal layer 3 near the edges of the slits 6 and 9, thus causing the liquid crystal molecules 3*a* to be oriented in a direction which is orthogonal to the extending direction of the slits 6 and 9. The slits 6 and the slits 9 are disposed parallel to one another, with a constant interval therebetween, so that liquid crystal regions (domains) are formed therebetween.

As mentioned above, as the first alignment regulating means and the second alignment regulating means, ribs or slits can be used in any arbitrary combination. The first electrode 1 and the second electrode 2 may be any electrodes that oppose each other via the liquid crystal layer 3; typically, one of them is a counter electrode, whereas the other is a pixel electrode. With respect to a case where the first electrode 1 is a counter electrode and the second electrode 2 is a pixel electrode, a more specific construction will be described below by taking as an example a liquid crystal display panel 10A which includes ribs 4 as the first alignment regulating means and slits 7 provided in the pixel electrode as the second alignment regulating means. Adopting the construction of the liquid crystal display panel 10A shown in FIG. 12(*a*) provides an advantage in that the increase in the number of production steps can be minimized. Providing slits in the pixel electrode does not require any steps. On the other hand, as for the counter electrode, providing ribs will induce a small increase in the number of steps than providing slits. It will be appreciated that a construction in which only ribs are employed as the alignment regulating means, or a construction in which only slits are employed, may be adopted.

Figure 13:
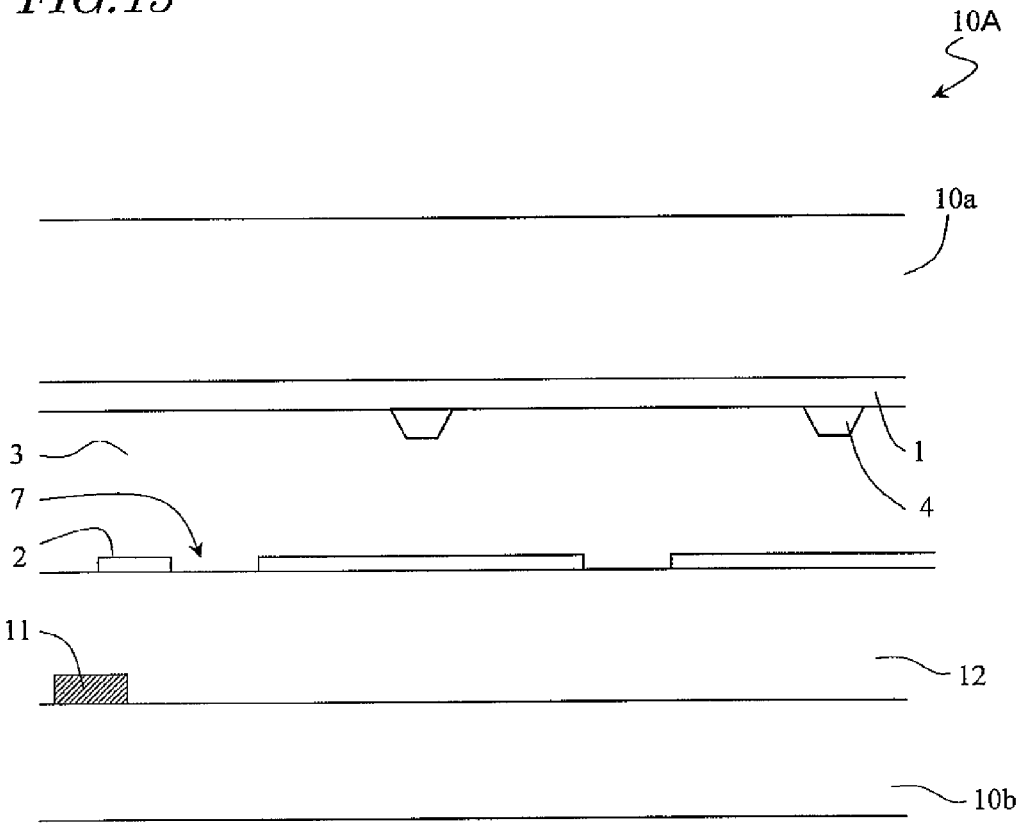
FIG. 13 A partial cross-sectional view schematically showing a cross-sectional structure of an MVA-mode liquid crystal display panel 10A.
Figure 14:
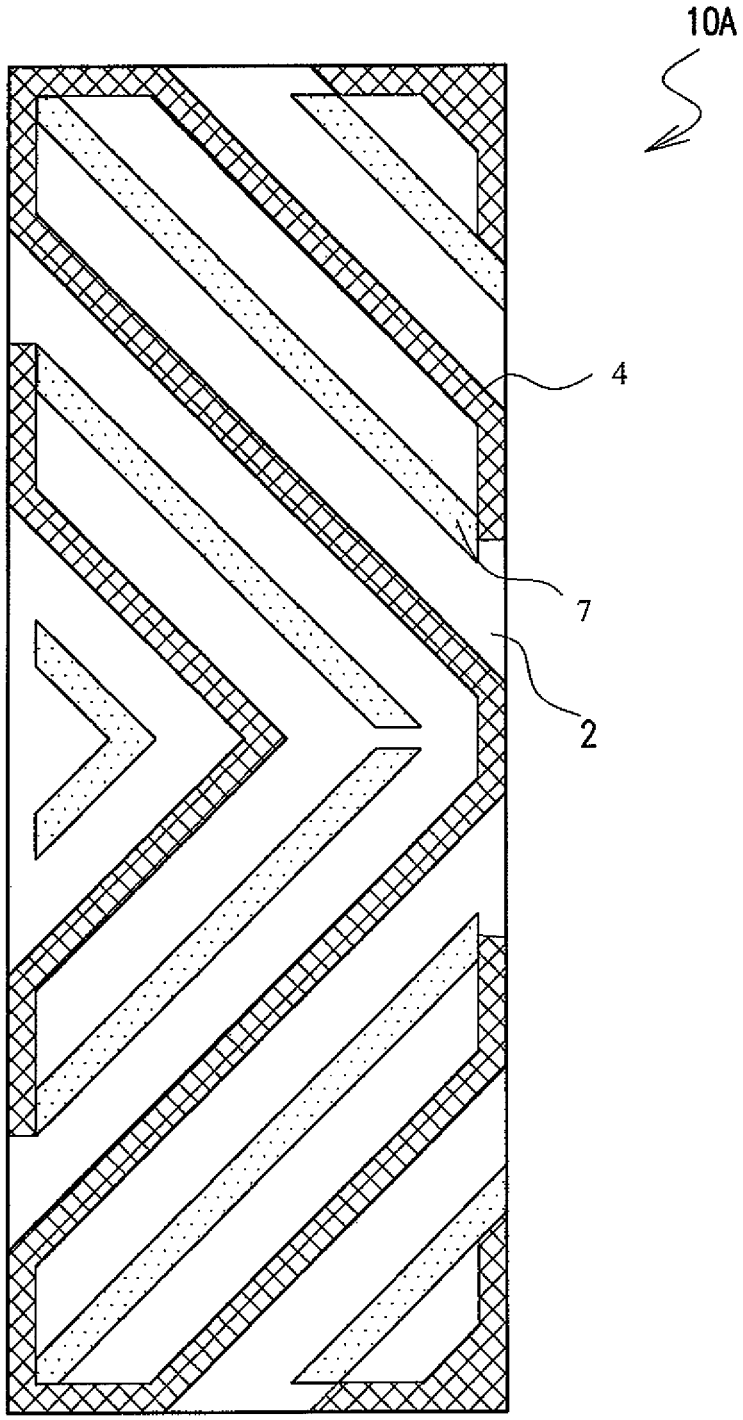
FIG. 14 A plan view schematically showing a region corresponding to one subpixel of the MVA-mode liquid crystal display panel 10A.

FIG. 13 is a partial cross-sectional view schematically showing a cross-sectional structure of the liquid crystal display panel 10A, and FIG. 14 is a plan view schematically showing a region corresponding to one subpixel of the liquid crystal display panel 10A.

The liquid crystal display panel 10A includes a first substrate (e.g., a glass substrate) 10*a* and a second substrate (e.g., a glass substrate) 10*b* opposing the first substrate 10*a*, and a vertical-alignment type liquid crystal layer 3 provided between the first substrate 10*a* and the second substrate 10*b*. On the liquid crystal layer 3 side of the first substrate 10*a*, the counter electrode 1 is formed, and the ribs 4 are formed further thereupon. A vertical alignment film (not shown) is formed on essentially the entire surface of the counter electrode 1 on the liquid crystal layer 3 side, including the ribs 4. As shown in FIG. 14, the ribs 4 extend in stripe shapes, and adjoining ribs 4 are disposed parallel to each other.

On the surface of the second substrate (e.g., glass substrate) 10*b* on the liquid crystal layer 3 side, gate bus lines (scanning lines) and source bus lines (signal lines) 11 and TFTs (not shown) are provided, and an interlayer insulating film 12 covering them is formed. The pixel electrodes 2 are formed on the interlayer insulating film 12. The pixel electrodes 2 and the counter electrode 1 oppose each other via the liquid crystal layer 3.

Stripe-shaped slits 7 are formed in the pixel electrode 2, and a vertical alignment film (not shown) is formed on essentially the entire surface of the pixel electrode 2, including the slits 7. The slits 7 extend in stripe shapes as shown in FIG. 14. Every two adjoining slits 7 are disposed parallel to each other, so as to substantially bisect the interval between the adjoining ribs 4.

Each region between the stripe-shaped ribs 4 and slits 7 extending in parallel to one another is restricted in terms of alignment direction by the rib 4 and slit 7 on both sides thereof. Thus, on both sides of each of the rib 4 and slit 7, domains are formed in which liquid crystal molecules 3*a* fall in directions which are 180° apart. In the liquid crystal display panel 10A, as shown in FIG. 14, ribs 4 and slits 7 extend in two directions which are 90° apart, so that, within each subpixel, four domains are formed, the alignment directions of whose liquid crystal molecules 3*a* are 90° apart.

A pair of polarizers (not shown) which are provided on both sides of the first substrate 10*a* and the second substrate 10*b* are disposed so that their transmission axes are substantially orthogonal to each other (crossed-Nicols state). By placing the polarizers so that their transmission axes constitute 45° with reference to each alignment direction of all of the four domains whose alignment directions are 90° apart, change in retardation caused by the formation of the domains can be utilized most efficiently. Therefore, the polarizers are preferably disposed so that their transmission axes constitute substantially 45° with respect to the extending direction of the ribs 4 and slits 7. Moreover, in the case of a display device for which the viewing direction is likely to be moved horizontally with respect to the display surface, e.g., a television set, it is preferable that the transmission axis of one of the pair of polarizers is in a horizontal direction with respect to the display surface, this being in order to suppress the viewing angle dependence of display quality.

In the liquid crystal display panel 10A having the above-described construction, within each subpixel, a plurality of regions (domains) are formed whose liquid crystal molecules 3*a* tilt in respectively different azimuth directions when a predetermined voltage is applied across the liquid crystal layer 3, thus realizing displaying with a wide viewing angle. However, even in the liquid crystal display panel 10A as such, a color shift due to whitening may occur under oblique observation. As in the liquid crystal display device 100 of the present embodiment, by independently driving or non-independently driving the first red subpixel R1 and the second red subpixel R2 depending on the hue of the color which is displayed by the pixel, a high quality displaying can be performed such that a deviation of chromaticity due to whitening is not likely to be visually recognized.

Next, an exemplary construction of the CPA-mode liquid crystal display panel 10 will be described with reference to FIG. 15.

Figure 15:
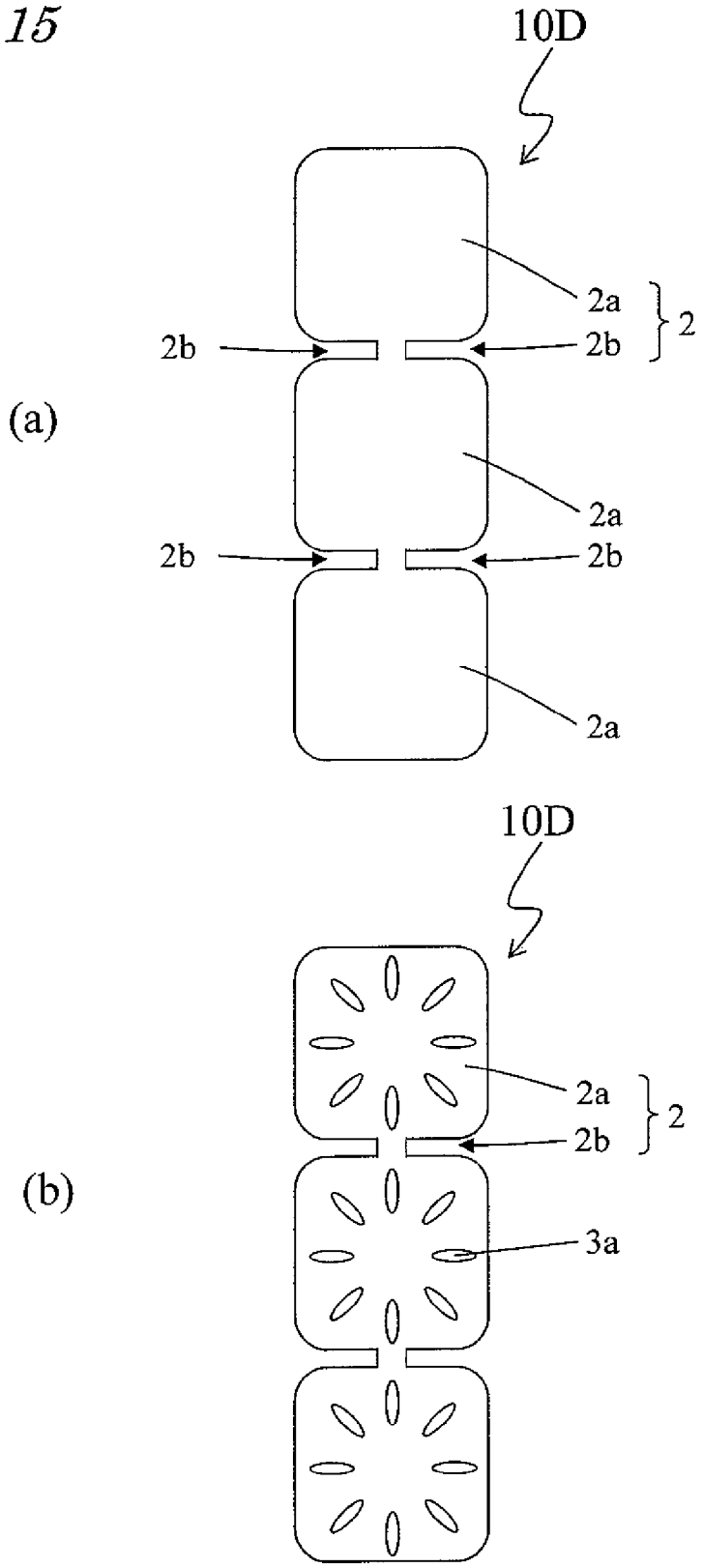
FIGS. 15 (*a*) and (*b*) are plan views schematically showing a region corresponding to one subpixel of a CPA-mode liquid crystal display panel 10D.

A pixel electrode 2 of a liquid crystal display panel 10D shown in FIG. 15(*a*) includes a plurality of recessed portions 2*b* formed at predetermined positions, and is divided into a plurality of subpixel electrodes 2*a* by the recessed portions 2*b*. Each of the plurality of subpixel electrodes 2*a* is substantially rectangular. Although an example is illustrated herein where the pixel electrode 2 is divided into three subpixel electrodes 2*a*, the number of division is not limited thereto.

When a voltage is applied between the pixel electrode 2 having the aforementioned construction and a counter electrode (not shown), due to oblique fields which are generated near the outer edge of the pixel electrode 2 and in the recessed portions 2*b*, a plurality of liquid crystal domains each exhibiting an axisymmetric alignment (radially-inclined alignment) are created, as shown in FIG. 15(*b*). One liquid crystal domain is formed above each subpixel electrode 2*a*. In each liquid crystal domain, the liquid crystal molecules 3*a* tilt in essentially all azimuth directions. That is, in the liquid crystal display panel 10D, numerous regions are formed whose liquid crystal molecules 3*a* tilt in respectively different azimuth directions. Therefore, displaying with a wide viewing angle is realized. However, even in the liquid crystal display panel 10D as such, a color shift due to whitening may occur under oblique observation. As in the liquid crystal display device 100 of the present embodiment, by independently driving or non-independently driving the first red subpixel R1 and the second red subpixel R2 depending on the hue of the color which is displayed by the pixel, a high quality displaying can be performed such that a deviation of chromaticity due to whitening is not likely to be visually recognized.

Figure 16:
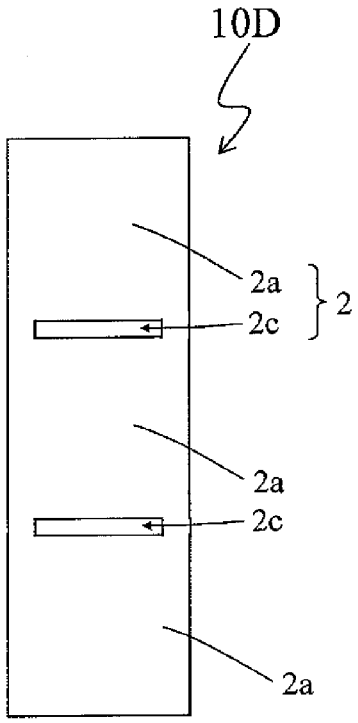
FIG. 16 A plan view schematically showing a region corresponding to one subpixel of the CPA-mode liquid crystal display panel 10D.
Figure 17:
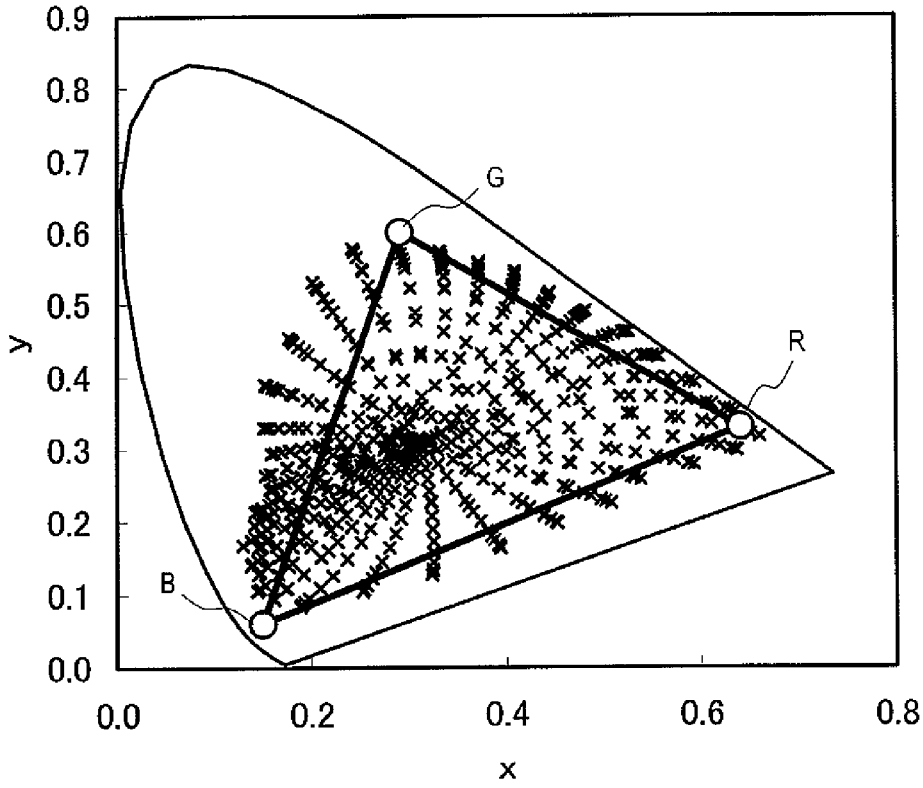
FIG. 17 An xy chromaticity diagram showing the color gamut of a three-primary LCD.
Figure 18:
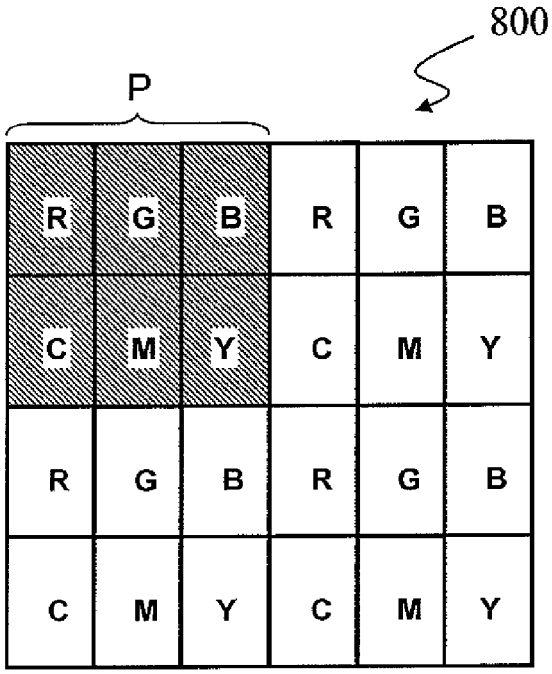
FIG. 18 A diagram schematically showing a conventional multiprimary LCD 800.
Figure 19:
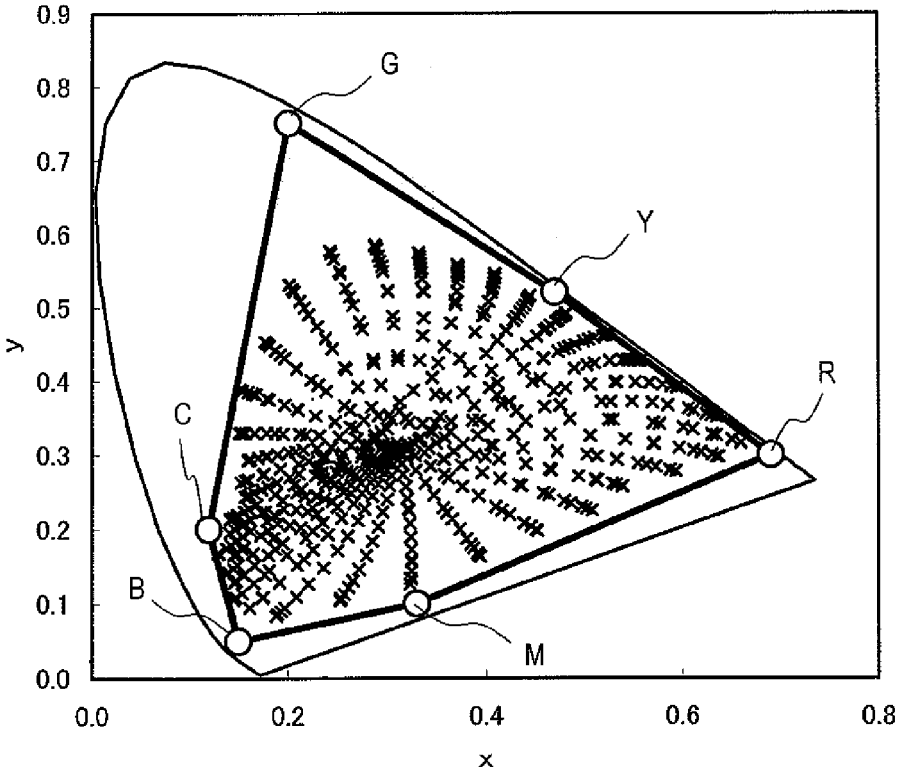
FIG. 19 An xy chromaticity diagram showing the color gamut of the multiprimary LCD 800.

Although FIG. 15 illustrates the pixel electrode 2 with the recessed portions 2*b* formed therein, apertures 2*c* may be formed instead of the recessed portions 2*b* as shown in FIG. 16. The pixel electrode 2 shown in FIG. 16 has a plurality of apertures 2*c*, and is divided into a plurality of subpixel electrodes 2*a* by the apertures 2*c*. When a voltage is applied between the pixel electrode 2 as such and a counter electrode (not shown), a plurality of liquid crystal domains each exhibiting an axisymmetric alignment (radially-inclined alignment) is created, due to oblique fields which are generated near the outer edge of the pixel electrode 2 and in the apertures 2*c*.

FIG. 15 and FIG. 16 illustrate constructions where a plurality of recessed portions 2*b* or apertures 2*c* are provided in one pixel electrode 2. In the case of dividing the pixel electrode 2 into halves, however, only one recessed portion 2*b* or aperture 2*c* may be provided. In other words, by providing at least one recessed portion 2*b* or aperture 2*c* in the pixel electrode 2, a plurality of liquid crystal domains with axisymmetric alignments can be formed. As the shape of the pixel electrode 2, various shapes as disclosed in Japanese Laid-Open Patent Publication No. 2003-43525, for example, may be used.

INDUSTRIAL APPLICABILITY

According to the present invention, the viewing angle characteristics of a multiprimary liquid crystal display device in which a plurality of red subpixels are provided in each pixel can be improved. In a multiprimary liquid crystal display device according to the present invention, a color shift due to whitening when being observed form an oblique direction is suppressed, thus making it possible to perform display with a high quality. Thus, a multiprimary liquid crystal display device according to the present invention is suitably used in various electronic devices such as liquid crystal television sets.

REFERENCE SIGNS LIST

R1 first red subpixel
R2 second red subpixel
G green subpixel
B blue subpixel
Y yellow subpixel
C cyan subpixel
10 liquid crystal display panel
20 signal conversion circuit
30 multiprimary signal generation circuit
40 red subpixel independent driving circuit
100 liquid crystal display device

The invention claimed is:

1. A multiprimary liquid crystal display device comprising a pixel defined by a plurality of subpixels, the multiprimary liquid crystal display device performing multicolor display by using four or more primary colors to be displayed by the plurality of subpixels, wherein, the plurality of subpixels include first and second red subpixels for displaying red, a green subpixel for displaying green, a blue subpixel for displaying blue, and a cyan subpixel for displaying cyan, there being a greater number of red subpixels in the pixel than any other color of subpixels; and when a color having a hue within a predetermined first range is displayed by the pixel, a gray scale level of the first red subpixel and a gray scale level of the second red subpixel differ from each other, and when a color having a hue within a second range which is different from the first range is displayed by the pixel, the gray scale level of the first red subpixel and the gray scale level of the second red subpixel are equal.

2. The multiprimary liquid crystal display device of claim 1, wherein the plurality of subpixels further include a yellow subpixel for displaying yellow.

3. A multiprimary liquid crystal display device comprising a pixel defined by a plurality of subpixels, the multiprimary liquid crystal display device performing multicolor display by using four or more primary colors to be displayed by the plurality of subpixels, wherein, the plurality of subpixels include first and second red subpixels for displaying red, a green subpixel for displaying green, a blue subpixel for displaying blue, and a yellow subpixel for displaying yellow, there being a greater number of red subpixels in the pixel than any other color of subpixels; and when a color having a hue within a predetermined first range is displayed by the pixel, a gray scale level of the first red subpixel and a gray scale level of the second red subpixel differ from each other, and when a color having a hue within a second range which is different from the first range is displayed by the pixel, the gray scale level of the first red subpixel and the gray scale level of the second red subpixel are equal.

4. The multiprimary liquid crystal display device of claim 1, comprising a multiprimary signal generation circuit for receiving an input video signal corresponding to three primaries and generating a multiprimary signal corresponding to four or more primary colors.

5. The multiprimary liquid crystal display device of claim 4, further comprising a red subpixel independent driving circuit for, depending on a hue of a color represented by the input video signal, determining the gray scale level of the first red subpixel and the gray scale level of the second red subpixel from a red component contained in the multiprimary signal.

6. The multiprimary liquid crystal display device of claim 5, wherein the red subpixel independent driving circuit uses a predetermined weight function to determine the gray scale level of the first red subpixel and the gray scale level of the second red subpixel.

7. The multiprimary liquid crystal display device of claim 6, wherein, the weight function is designated as H; gray scale levels of a red component, a green component, and a blue component contained in the input video signal are Rin, Gin, and Bin, respectively; a normalized luminance represented by the red component contained in the multiprimary signal is Y(Rout); and normalized luminances of the first red subpixel and the second red subpixel are Y(R1out) and Y(R2out), respectively, and the weight function H is expressed as $$H=(R\text{in}-G\text{in})/R\text{in} \text{ in the case where } R\text{in}>G\text{in}>B\text{in},$$

$$H=(R\text{in}-B\text{in})/R\text{in} \text{ in the case where } R\text{in}>B\text{in}>G\text{in}, \text{ or}$$

$$H=0 \text{ in any other case, and}$$

the normalized luminance Y(R1out) of the first red subpixel and the normalized luminance Y(R2out) of the second red subpixel are expressed as $$Y(R1\text{out})=H\times Y(R\text{out}) \text{ and}$$

$$Y(R2\text{out})=(2-H)\times Y(R\text{out}) \text{ in the case where } (2-H)\times Y(R\text{out})\leq 1, \text{ or}$$

$$Y(R1\text{out})=2\times Y(R\text{out})-1 \text{ and}$$

$$Y(R2\text{out})=1 \text{ in the case where } (2-H)\times Y(R\text{out})>1.$$

8. The multiprimary liquid crystal display device of claim 1, wherein the multiprimary liquid crystal display device performs display in a vertical alignment mode.

9. A signal conversion circuit for use in a multiprimary liquid crystal display device having a pixel defined by a plurality of subpixels including first and second red subpixels for displaying red, a green subpixel for displaying green, a blue subpixel for displaying blue, and a cyan subpixel for displaying cyan, there being a greater number of red subpixels in the pixel than any other color of subpixels, the multiprimary liquid crystal display device performing multicolor display by using four or more primary colors to be displayed by the plurality of subpixels, the signal conversion circuit comprising:

a multiprimary signal generation circuit for receiving an input video signal corresponding to three primaries and generating a multiprimary signal corresponding to four or more primary colors; and a red subpixel independent driving circuit for, depending on a hue of a color represented by the input video signal, determining the gray scale level of the first red subpixel and the gray scale level of the second red subpixel from a red component contained in the multiprimary signal.

10. A signal conversion circuit for use in a multiprimary liquid crystal display device having a pixel defined by a plurality of subpixels including first and second red subpixels for displaying red, a green subpixel for displaying green, a blue subpixel for displaying blue, and a yellow subpixel for displaying yellow, there being a greater number of red subpixels in the pixel than any other color of subpixels, the multiprimary liquid crystal display device performing multicolor display by using four or more primary colors to be displayed by the plurality of subpixels, the signal conversion circuit comprising:

a multiprimary signal generation circuit for receiving an input video signal corresponding to three primaries and generating a multiprimary signal corresponding to four or more primary colors; and a red subpixel independent driving circuit for, depending on a hue of a color represented by the input video signal, determining the gray scale level of the first red subpixel and the gray scale level of the second red subpixel from a red component contained in the multiprimary signal.

11. The signal conversion circuit of claim 9, wherein the red subpixel independent driving circuit uses a predetermined weight function to determine the gray scale level of the first red subpixel and the gray scale level of the second red subpixel.

12. The signal conversion circuit of claim 11, wherein, the weight function is designated as H; gray scale levels of a red component, a green component, and a blue component contained in the input video signal are Rin, Gin, and Bin, respectively; a normalized luminance represented by the red component contained in the multiprimary signal is Y(Rout); and normalized luminances of the first red subpixel and the second red subpixel are Y(R1out) and Y(R2out), respectively, and the weight function H is expressed as $$H=(R\text{in}-G\text{in})/R\text{in} \text{ in the case where } R\text{in}>G\text{in}>B\text{in},$$

$$H=(R\text{in}-B\text{in})/\text{Rin} \text{ in the case where } R\text{in}>B\text{in}>G\text{in}, \text{ or}$$

$$H=0 \text{ in any other case, and}$$

the normalized luminance Y(R1out) of the first red subpixel and the normalized luminance Y(R2out) of the second red subpixel are expressed as $$Y(R1\text{out})=H\times Y(R\text{out}) \text{ and}$$

$$Y(R2\text{out})=(2-H)\times Y(R\text{out}) \text{ in the case where } (2-H)\times Y(R\text{out})\leq 1, \text{ or}$$

$$Y(R1\text{out})=2\times Y(R\text{out})-1 \text{ and}$$

$$Y(R2\text{out})=1 \text{ in the case where } (2-H)\times Y(R\text{out})>1.$$

13. A multiprimary liquid crystal display device comprising the signal conversion circuit of claim 9.

14. The multiprimary liquid crystal display device of claim 3, comprising a multiprimary signal generation circuit for receiving an input video signal corresponding to three primaries and generating a multiprimary signal corresponding to four or more primary colors.

15. The multiprimary liquid crystal display device of claim 14, further comprising a red subpixel independent driving circuit for, depending on a hue of a color represented by the input video signal, determining the gray scale level of the first red subpixel and the gray scale level of the second red subpixel from a red component contained in the multiprimary signal.

16. The multiprimary liquid crystal display device of claim 15, wherein the red subpixel independent driving circuit uses a predetermined weight function to determine the gray scale level of the first red subpixel and the gray scale level of the second red subpixel.

17. The multiprimary liquid crystal display device of claim 16, wherein, the weight function is designated as H; gray scale levels of a red component, a green component, and a blue component contained in the input video signal are Rin, Gin, and Bin, respectively; a normalized luminance represented by the red component contained in the multiprimary signal is Y(Rout);and normalized luminances of the first red subpixel and the second red subpixel are Y(R1out) and Y(R2out), respectively, and the weight function H is expressed as $$H=(R\text{in}-G\text{in})/R\text{in} \text{ in the case where } R\text{in}>G\text{in}>B\text{in},$$

$$H=(R\text{in}-B\text{in})/\text{Rin} \text{ in the case where } R\text{in}>B\text{in}>G\text{in}, \text{ or}$$

$$H=0 \text{ in any other case, and}$$

the normalized luminance Y(R1out) of the first red subpixel and the normalized luminance Y(R2out) of the second red subpixel are expressed as $$Y(R1\text{out})=H\times Y(R\text{out}) \text{ and}$$

$$Y(R2\text{out})=(2-H)\times Y(R\text{out}) \text{ in the case where } (2-H)\times Y(R\text{out})\leq 1, \text{ or}$$

$$Y(R1\text{out})=2\times Y(R\text{out})-1 \text{ and}$$

$$Y(R2\text{out})=1 \text{ in the case where } (2-H)\times Y(R\text{out})>1.$$

18. The multiprimary liquid crystal display device of claim 3, wherein the multiprimary liquid crystal display device performs display in a vertical alignment mode.

19. The signal conversion circuit of claim 10, wherein the red subpixel independent driving circuit uses a predetermined weight function to determine the gray scale level of the first red subpixel and the gray scale level of the second red subpixel.

20. The signal conversion circuit of claim 19, wherein, the weight function is designated as H; gray scale levels of a red component, a green component, and a blue component contained in the input video signal are Rin, Gin, and Bin, respectively; a normalized luminance represented by the red component contained in the multiprimary signal is Y(Rout); and normalized luminances of the first red subpixel and the second red subpixel are Y(R1out) and Y(R2out), respectively, and the weight function H is expressed as $$H=(R\text{in}-G\text{in})/R\text{in} \text{ in the case where } R\text{in}>G\text{in}>B\text{in},$$

$$H=(R\text{in}-B\text{in})/\text{Rin} \text{ in the case where } R\text{in}>B\text{in}>G\text{in}, \text{ or}$$

$$H=0 \text{ in any other case, and}$$

the normalized luminance Y(R1out) of the first red subpixel and the normalized luminance Y(R2out) of the second red subpixel are expressed as $$Y(R1\text{out})=H\times Y(R\text{out}) \text{ and}$$

$$Y(R2\text{out})=(2-H)\times Y(R\text{out}) \text{ in the case where } (2-H)\times Y(R\text{out})\leq 1, \text{ or}$$

$$Y(R1\text{out})=2\times Y(R\text{out})-1 \text{ and}$$

$$Y(R2\text{out})=1 \text{ in the case where } (2-H)\times Y(R\text{out})>1.$$

21. A multiprimary liquid crystal display device comprising the signal conversion circuit of claim 10.

* * * * *